US005907131A

United States Patent [19]

Tello

[11] Patent Number: 5,907,131

[45] Date of Patent: May 25, 1999

[54] METHOD AND SYSTEM FOR CEMENT BOND EVALUATION HIGH ACOUSTIC VELOCITY FORMATIONS

[75] Inventor: Lucio N. Tello, Fort Worth, Tex.

[73] Assignee: Computalog U.S.A., Inc., Fort Worth, Tex.

[21] Appl. No.: 08/921,923

[22] Filed: Aug. 27, 1997

[51] Int. Cl.[6] ..... G01V 1/40

[52] U.S. Cl. ..... 181/102; 181/105; 367/35

[58] Field of Search ..... 181/102, 105; 367/25, 28–32, 35, 47, 86

[56] References Cited

U.S. PATENT DOCUMENTS

| | | | |
|---|---|---|---|
| 4,255,798 | 3/1981 | Havira | 367/35 |
| 4,495,606 | 1/1985 | Smith | 367/86 |
| 4,757,479 | 7/1988 | Masson et al. | 367/35 |
| 4,893,285 | 1/1990 | Masson et al. | 367/35 |
| 5,216,638 | 6/1993 | Wright | 367/35 |
| 5,377,160 | 12/1994 | Tello et al. | 367/35 |

*Primary Examiner*—Khanh Dang
*Attorney, Agent, or Firm*—Andrew J. Dillon

[57] ABSTRACT

An acoustic logging tool having an acoustic transmitter and at least one acoustic receiver longitudinally spaced from the transmitter is lowered into a borehole fluid within a tubular member having a known resonant frequency. A pulse of acoustic energy is then transmitted into the tubular member, and acoustic energy traversing the tubular member and formation is detected at the acoustic receiver. A frequency domain transformation is performed on the detected acoustic energy and a cement bond evaluation is performed by comparing transformed detected acoustic energy amplitudes within a predetermined range of the resonant frequency of the tubular member, effectively filtering out acoustic energy which traverses the formation surrounding the tubular member.

9 Claims, 10 Drawing Sheets

METHOD AND SYSTEM FOR CEMENT BOND EVALUATION HIGH ACOUSTIC VELOCITY FORMATIONS

BACKGROUND OF THE INVENTION

1. Technical Field

The present invention relates, in general, to sonic well logging tools for radially evaluating cementing conditions around casing in cased wells and, in particular, to a method and system for circumferentially evaluating the placement and bonding strength of cement-sealing material disposed about the exterior surface of a tubular member within a wellbore in an acoustically fast formation.

2. Description of the Related Art

Prior-art sonic well logging tools have been used to evaluate cement bonding around casing within wellbores for many years. Typically, cement bonding is a term which has been used to describe a measure of an average compressive strength of cement disposed about a section of casing, which provides an indication of cement conditions within the wellbore, such as proper cure, mixture with borehole fluids and voids or channeling within a cement sheath. In general, cement-bonding measurements are used to provide an indication of cement placement about a well casing to determine whether the cement provides an adequate fluid seal to prevent fluids from flowing between portions of a wellbore.

Prior-art sonic well logging tools have been utilized to radially determine cement conditions within cased wellbores, from which the circumferential placement of cement about the exterior of a casing can be evaluated. For example, pulse-echo types of well logging tools have been used to transmit an initial sonic pulse radially outward from a sonic transducer to a spot on a casing wall, and the reflected sonic signal or echo then is received, utilizing a sonic transducer to evaluate the quality of the cement bond.

Examples of pulse-echo sonic tools are disclosed in U.S. Pat. Nos. 3,369,626; 4,255,798; 4,709,357; 3,369,626; 4,255,798; and 4,709,357, the contents of which hereby are incorporated herein by reference thereto.

A problem which exists with known techniques for measuring cementing conditions in cased wells is the presence of high-acoustic velocity or so-called "fast" formations. In such a situation, the velocity of the acoustic pulse in the high-acoustic velocity formation sometimes may be faster than the velocity of sound in the casing or pipe. Under these conditions, the return signal arrival through the pipe may be distorted by the arrival of acoustic signals travelling through the formation and, very often, this condition produces a combined arrival with a large amplitude which would otherwise indicate a poor bond or a total absence of a cement seal. Solutions to this problem have been proposed in U.S. Pat. No. 4,757,479 and 4,893,285 which disclose the addition of an additional receiver at a small distance from the transmitter. This solution is substantially ineffective in large diameter casings, such as 7 inches or greater, and/or when the cement layer is relatively thin—that is, one-inch thick or less.

It therefore should be apparent that a need exists for a method and system for accurately evaluating cement bond conditions between a tubular member and the wellbore in the presence of a high-acoustic velocity formation.

SUMMARY OF THE INVENTION

It therefore is one object of the present invention to provide an improved sonic well logging tool.

It is another object of the present invention to provide an improved sonic well logging tool for radially evaluating cementing conditions around casing in cased wells.

It is yet another object of the present invention to provide an improved method and system for evaluating the placement and bonding strength of cement sealing material disposed about the exterior surface of a tubular member within a borehole in an high-acoustic velocity formation.

The foregoing objects are achieved as is now described. A method and system for cement bond evaluation in high-acoustic velocity formations is provided. An acoustic logging tool having an acoustic transmitter and at least one acoustic receiver longitudinally spaced from the transmitter is lowered into borehole fluid within a tubular member having a known resonant frequency. A pulse of acoustic energy then is transmitted into the tubular member and acoustic energy traversing the tubular member and formation is detected at the acoustic receiver. A frequency domain transformation then is performed on the detected acoustic energy, and a cement bond evaluation is performed by comparing transformed detected acoustic energy amplitudes only within a predetermined range of the resonant frequency of the tubular member, effectively filtering out acoustic energy which traverses the formation surrounding the tubular member.

The above as well as additional objectives, features and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
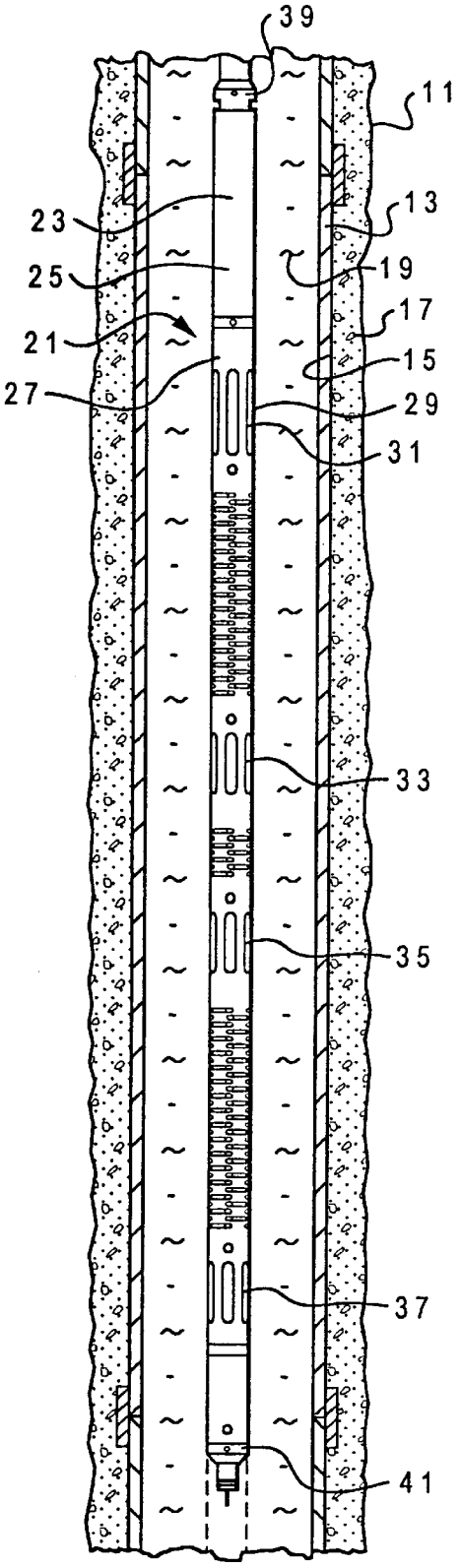
FIG. 1 is a partial longitudinal sectional view of a wellbore having a casing string extending longitudinally therein and within which is depicted a perspective view of a sonic well logging tool which may be utilized to implement the method and system of the present invention.

With reference now to the figures and, in particular, with reference to FIG. 1, a partial longitudinal sectional view depicts wellbore 11 within which casing string 13 extends. Well casing string 13 includes tubular member 15. Cement 17 is shown in an annulus about the exterior of well-casing string 13. Cement 17 provides a sealing material for preventing communication of fluids between different formation intervals within the annulus within wellbore 11 and well casing 13. Borehole fluid 19 is shown within casing string 13. Sonic well logging tool 21, which in the preferred embodiment of the present invention is a sector bond tool, is shown within casing 13. Sonic well logging tool 21 includes housing 23 within which are disposed electronic section 25 and sonde section 27.

Sonde section 27 includes a plurality of sonic transducers. The plurality of sonic transducers include monopole transmitter-transducer 29, eight-sector transmitter-transducers 31, eight receiver-transducers 33, first monopole receiver-transducer 35, and second monopole receiver-transducer 37. Sector transmitter-transducers 31 provide a first portion of the sonic transducers for transmitting a sonic signal to tubular member 15 and sector receiver-transducers 33 provide a second portion of the sonic transducers for receiving the transmitted sonic signals and emitting a plurality of electric signals from which a circumferential placement and bonding of cement longitudinally along tubular member 15 may be determined.

Monopole transmitter-transducer 29, first monopole receiver-transducer 35 and second monopole receiver-transducer 37 provide a plurality of sonic transducers for measuring the amplitude and for providing a variable-density log (VDL) display for a standard cement bond log. First monopole receiver-transducer 35 is spaced approximately three feet away from monopole transmitter-transducer 29 for measuring the cement-bonding average amplitude. Second monopole receiver-transducer 37 is spaced approximately five feet away from monopole transmitter-transducer 29 for providing the variable-density log (VDL) display. In a preferred embodiment of the present invention, monopole transmitter-transducer 29 transmits a sonic signal having a frequency of 20 to 30 kHz and first monopole receiver-transducer 35 and second monopole receiver-transducer 37 are provided to receive this sonic signal transmitted by monopole transmitter-transducer 29.

Housing 23 includes an upper connector 39 for connecting sonic well logging tool 21 to a wireline cable, such as, for example, a high-pressure wireline cable having only one insulated conductor. Housing 23 further includes lower connector 41 for either connecting to a bullnose, or for connecting sonic well logging tool 21 to other downhole well logging tools within a tool string in which sonic well-logging tool 21 is included.

One example of a sonic well logging tool suitable for implementing the method and system of the present invention is depicted in U.S. Pat. No. 5,377,160, issued Dec. 27, 1994, naming as one inventor the inventor herein named. The content of U.S. Pat. No. 5,377,160 hereby is incorporated herein by reference thereto.

Figure 2:
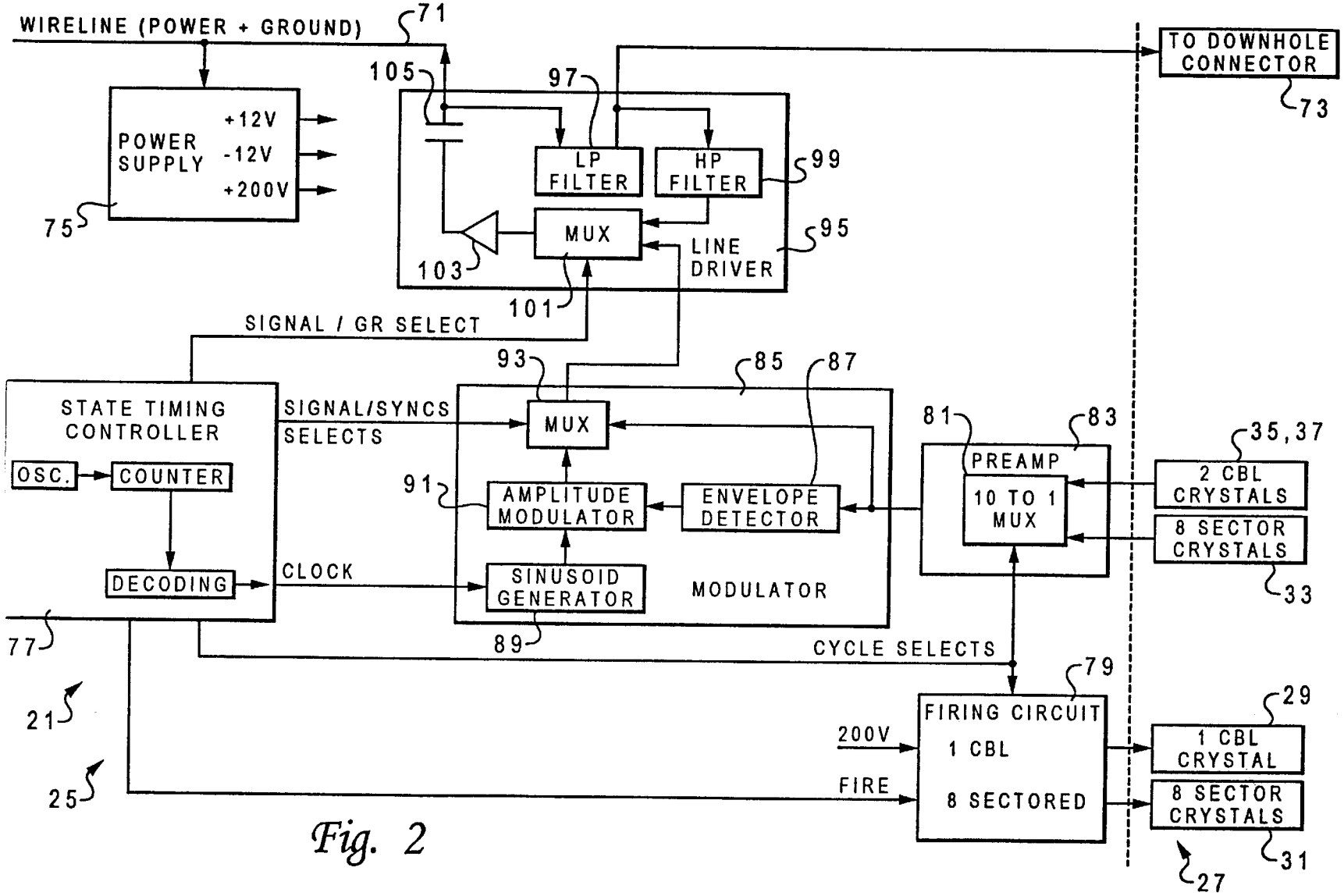
FIG. 2 is a block diagram of the electronics portion of the sonic well logging tool of FIG. 1.

Referring now to FIG. 2, there is depicted a block diagram of the electronics portion of the sonic well logging tool of FIG. 1. As illustrated, the electronics portion of electronic section 25 and sonde section 27 are depicted. Wireline cable 71 is shown extending to power supply 75. Power supply 75 provides power to sonic well logging tool 21. State and timing controller 77 provides a fire signal to firing circuit 79 to control firing of monopole transmitter-transducer 29 and sector transmitter-transducers 31 in sonde section 27. State timing controller 77 additionally selects the cycle, or sequence, in which sonic transducers are fired and select-switch sonic transducers are gated to pass a received signal to multiplexer 81, preamplifier 83, and modulator 85.

Modulator 85 includes an envelope detector 87, sinusoid generator 89, amplitude modulator 91 and multiplexer 93. State timing controller 77 selects whether multiplexer 93 passes one of the cement bond log sonic signals from monopole receiver-transducer 35 or monopole receiver-transducer 37, or whether multiplexer 93 passes an amplitude modulated signal from amplitude modulator 92, which corresponds to one of the electrical signals emitted from sector receiver-transducers 33. Amplitude modulator 91 receives a 20 kHz sinusoid signal from sinusoid generator 89. Amplitude modulator 91 additionally receives an electric signal from envelope detector 87, which takes the electrical signal generated by one of the sector receiver-transducers 33, as selected by multiplexer 81, rectifies and then integrates the signal within any envelope to provide a signal to amplitude modulator 91. Amplitude modulator 91 then modulates the amplitude of the 20 kHz sinusoid signal generated by sinusoid generator 89 to an amplitude level which corresponds to the signal from envelope detector 87. Multiplexer 93 then passes the appropriate signal, as selected by state timing controller 77, to line driver 95.

Line driver 95 includes a low pass filter 97 for passing power from wireline 71 to downhole connector 73 for powering tools which may be positioned in the portion of the tool string below sonic well logging tool 21, such as, for example, a gamma ray tool. Line driver 95 further includes high pass filter 99 for passing signals for downhole tools such as, for example, gamma ray counts from a gamma ray tool which may be connected below sonic well logging tool 21. Line driver 95 further includes multiplexer 101, which is selectively operated by state timing controller 77 to either pass the signal from multiplexer 93 of modulator 85, or to pass the signal from high pass filter 99, which may pass signals such as gamma ray counts from a gamma ray tool. Amplifier 103 is provided between multiplexer 101 and wireline 71. Capacitor 105 is provided to prevent DC voltage from passing from wireline 71 into amplifier 103 and multiplexer 101.

Figure 3:
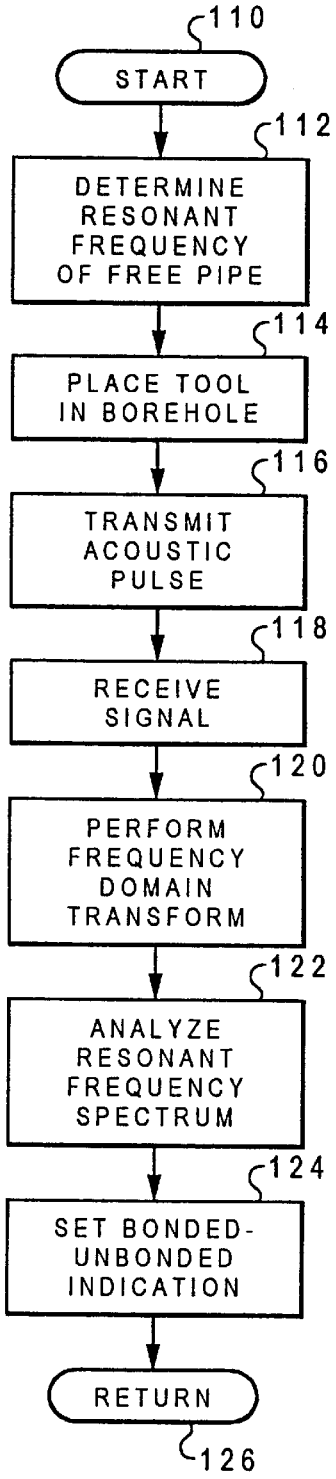
FIG. 3 is a high-level logic flowchart illustrating the process of cement bond evaluation in accordance with the method and system of the present invention.

With reference now to FIG. 3, there is depicted a high-level logic flowchart illustrating the process of cement-bond evaluation in accordance with the method and system of the present invention. As depicted, this process begins at block 110 and thereafter passes to block 112. Block 112 illustrates a determination of the resonant frequency of free pipe. Those skilled in the art will appreciate that the resonant frequency of a pipe or casing will be dependent upon the thickness, diameter and other construction parameters of the pipe. This may be determined by suspending a portion of casing or pipe in the air or water in an appropriate jig and, thereafter, pulsing the pipe with an appropriate acoustic signal.

Next, the process passes to block 114. Block 114 illustrates the placing of the tool in the borehole and, thereafter, as depicted at block 116, the periodic transmission of acoustic pulse energy.

Block 118 illustrates the reception of acoustic signals which have travelled through the formation and casing.

Next, in accordance with an important feature of the present invention, a frequency domain transformation is performed on the received signal. In the depicted embodiment of the present invention, a Fourier transform is performed; however, other suitable frequency domain transformations may be utilized.

Next, as illustrated within block 122, the frequency domain transformed signal is analyzed within a predetermined frequency of the resonant frequency determined above with respect to step 112. In the depicted embodiment of the present invention, the received signal is analyzed within a frequency window which extends 3 kHz on either side of the determined resonant frequency. Thereafter, as depicted in block 124, the bonded or unbonded indication of the casing at that point may be determined in a manner which will be illustrated in greater detail herein. Thereafter, the process passes to block 126 and returns.

Figure 4A:
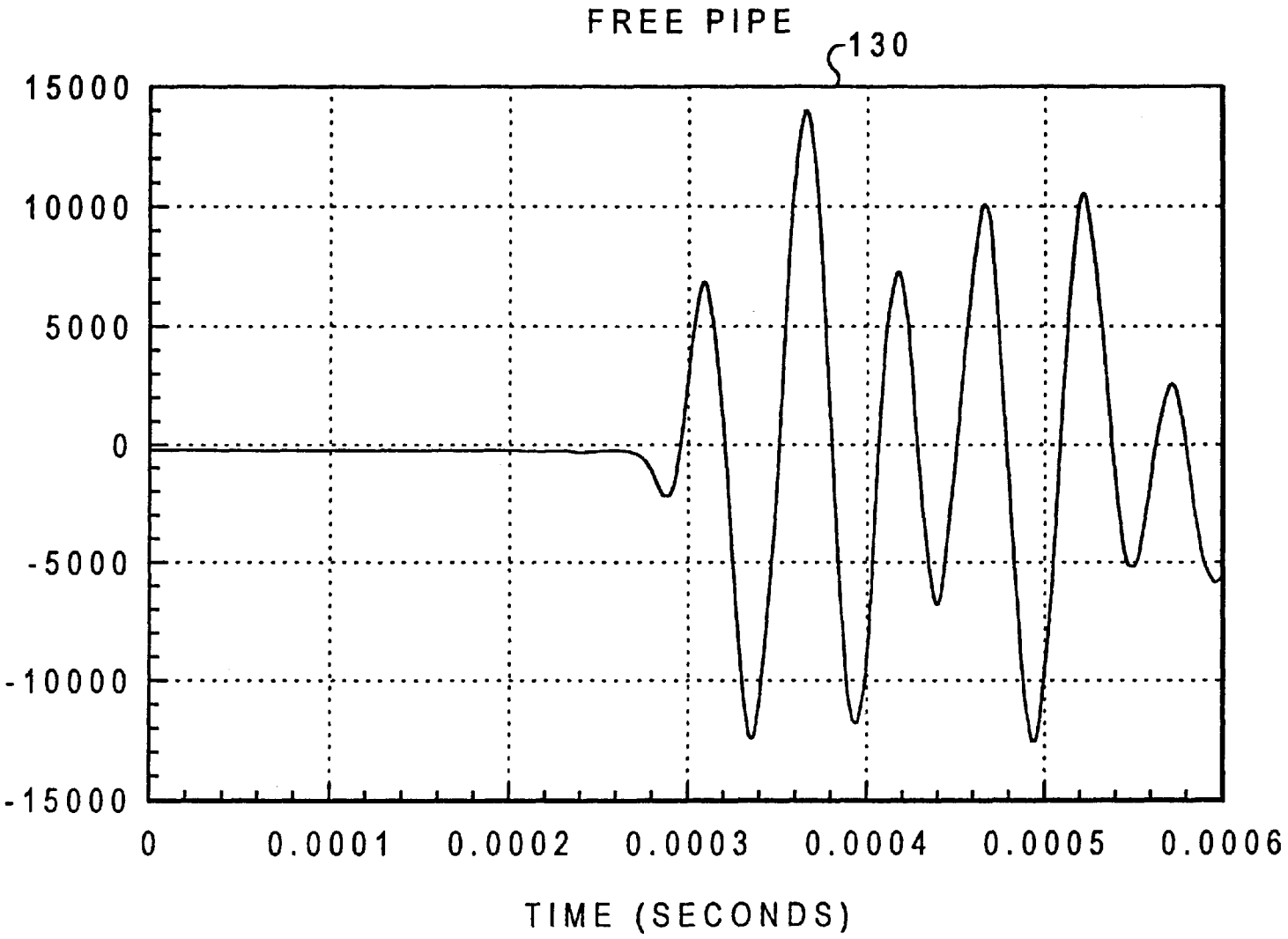
FIG. 4*a* is a time-domain representation of approximately 600 microseconds of received signal resultant from excitation of a free casing pipe by a short-duration acoustic pulse.
Figure 4B:
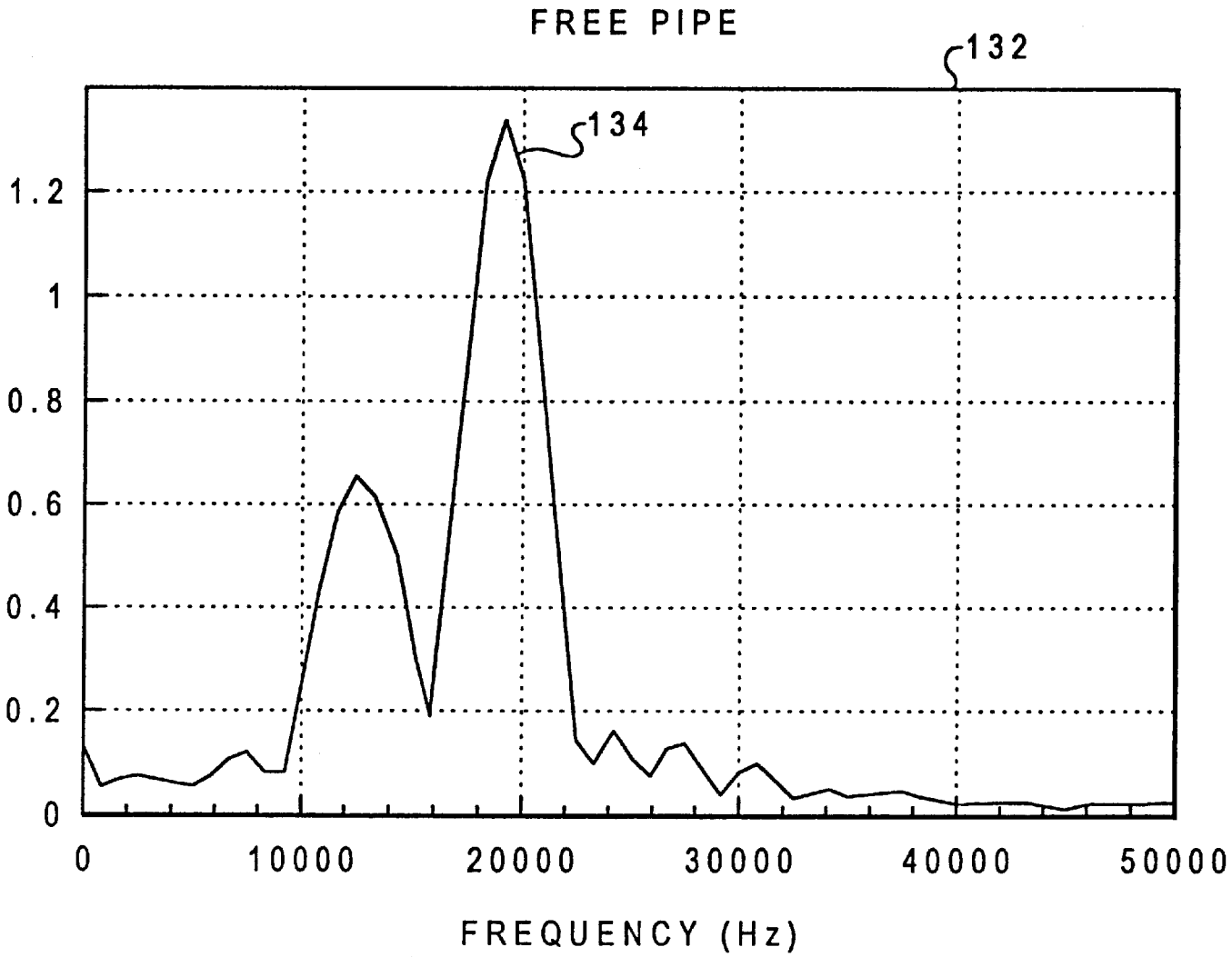
FIG. 4*b* is a frequency domain transformation of the time-domain representation of FIG. 4*a;*

Referring now to FIG. 4*a,* there is depicted a time-domain representation 130 of approximately 600 microseconds of received signal which is resultant from excitation of a free casing pipe by a short-duration acoustic pulse. Upon the performance of a frequency domain transformation, the representation 132 set forth within FIG. 4*b* is determined. As illustrated, at approximately 20 kHz, the resonant frequency of the casing results in a large amplitude spike 134 at the resonant frequency of the pipe. This may be determined for individual casing sizes and thicknesses in any suitable test jig.

Figure 5A:
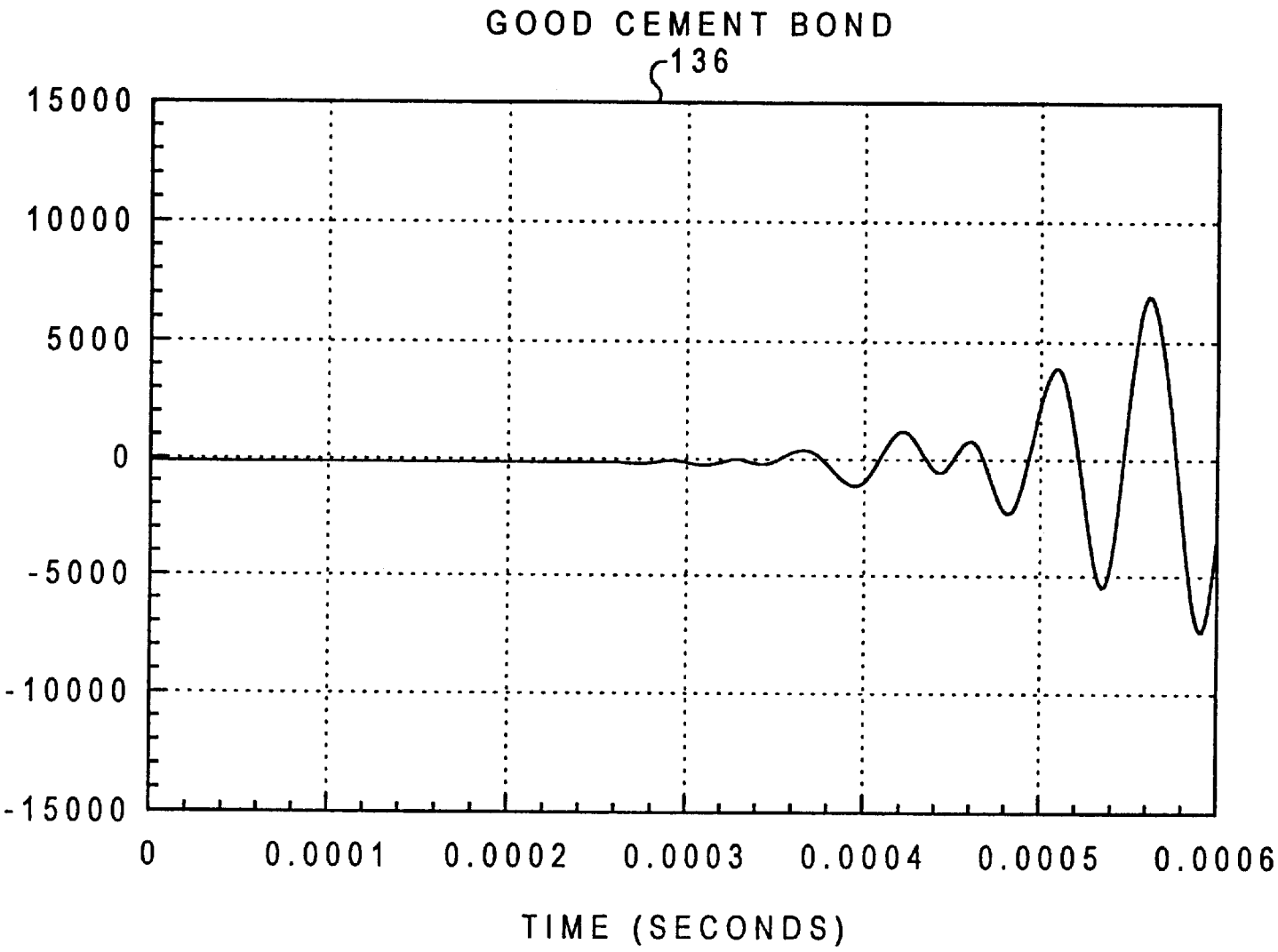
FIG. 5*a* is a time-domain representation of approximately 600 microseconds of received signal resultant from excitation of a fully bonded casing pipe by a short-duration acoustic pulse.
Figure 5B:
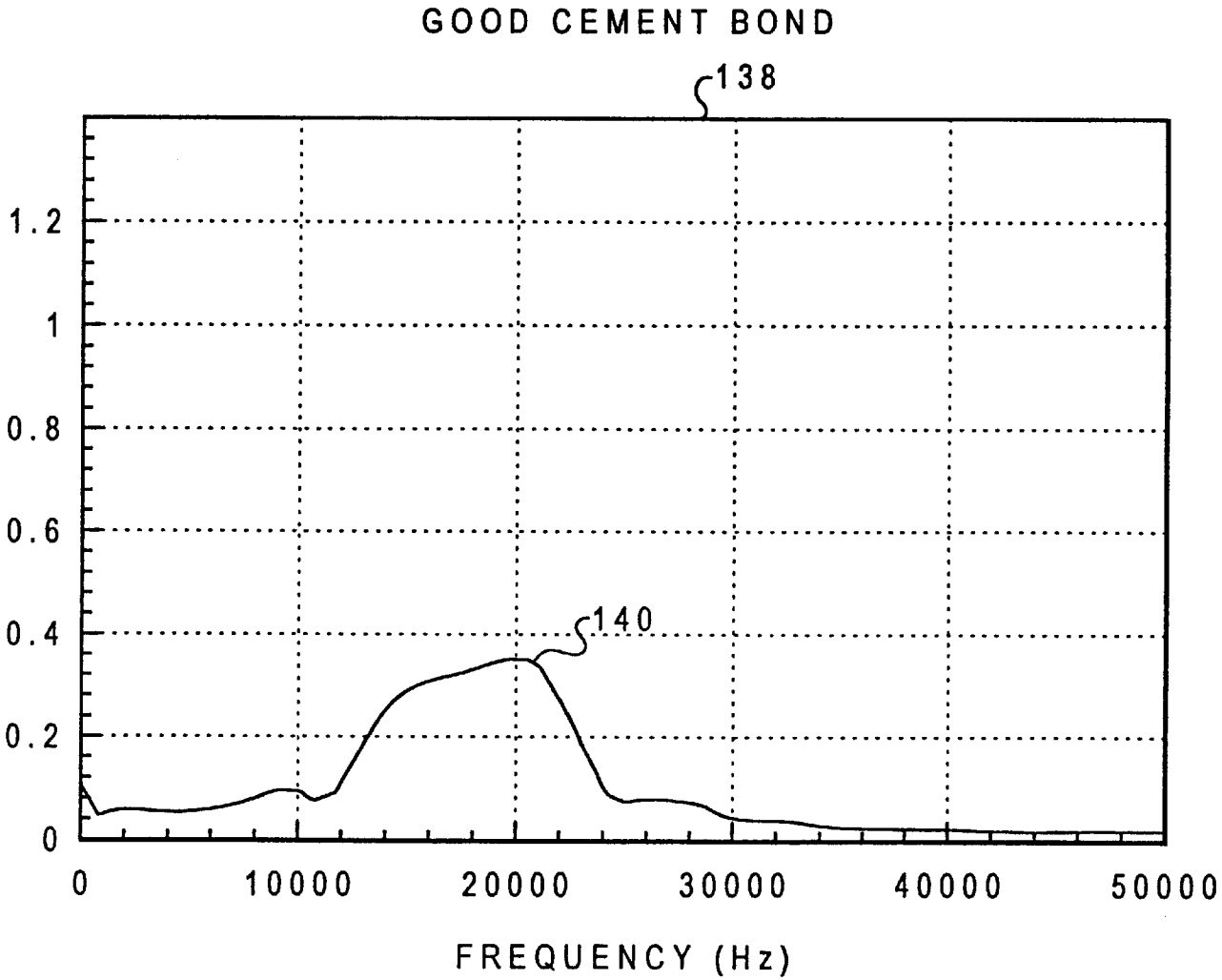
FIG. 5*b* is a frequency domain transportation of the time-domain representation of FIG. 5*a;*

With reference now to FIG. 5*a,* there is depicted a time-domain representation 136 of approximately 600 microseconds of received signal resultant from excitation of a fully bonded casing pipe by a short-duration acoustic pulse. FIG. 5*b* depicts a frequency domain transformation 138 of the time-domain representation of FIG. 5*a* and, as may be clearly seen when comparing FIG. 4*b* and FIG. 5*b,* the peak amplitude 140 within FIG. 5*b* is approximately one-fifth the amplitude of the resonant frequency peak within FIG. 4*b.* Further, the frequency at which peak 140 is detected within FIG. 5*b* is proximate to the 20 kHz depicted within FIG. 4*b.*

Figure 6A:
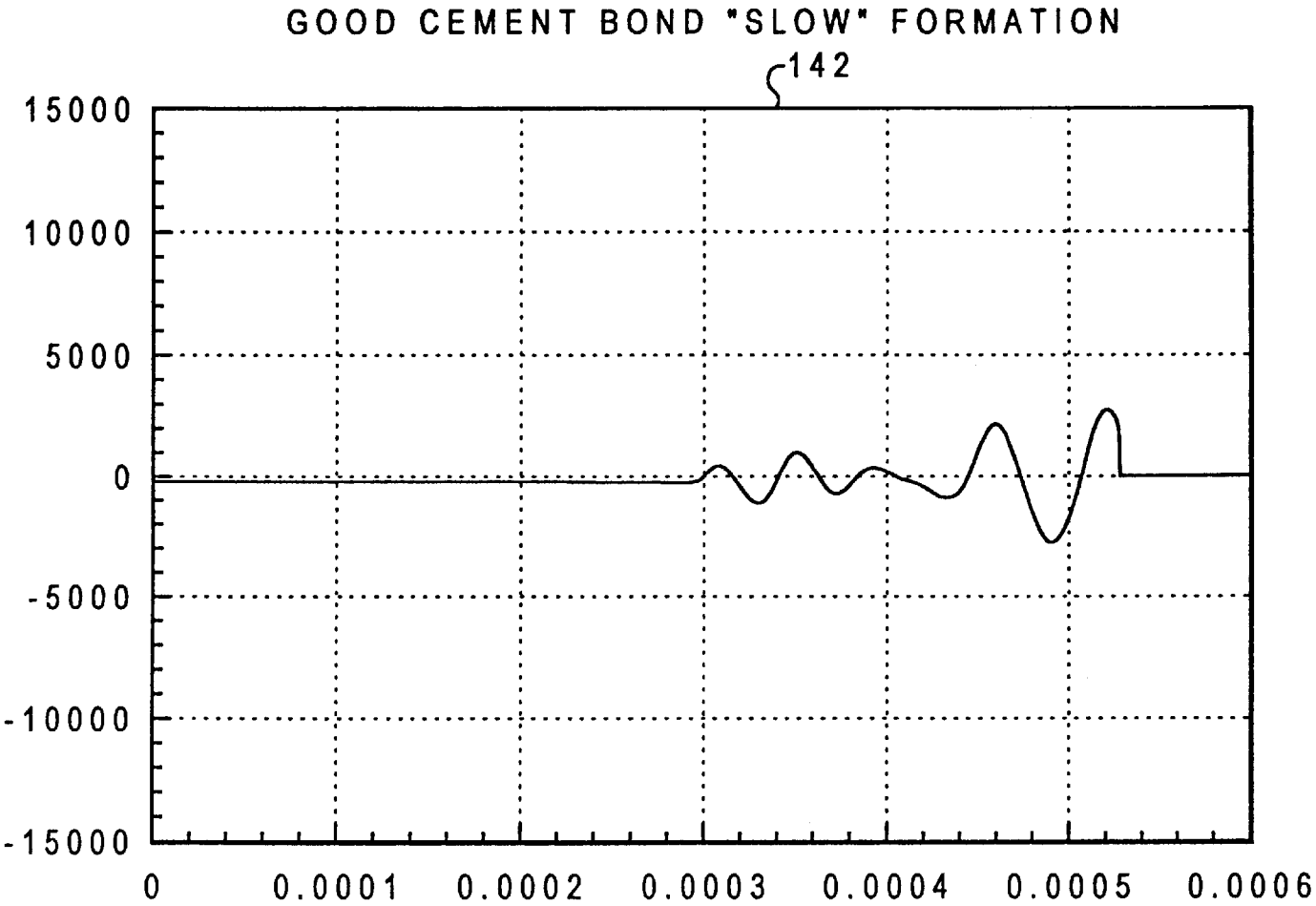
FIG. 6*a* is a time-domain representation of approximately 500 microseconds of a received signal resultant from excitation of a fully bonded casing pipe by a short-duration acoustic pulse within a "slow" formation.
Figure 6B:
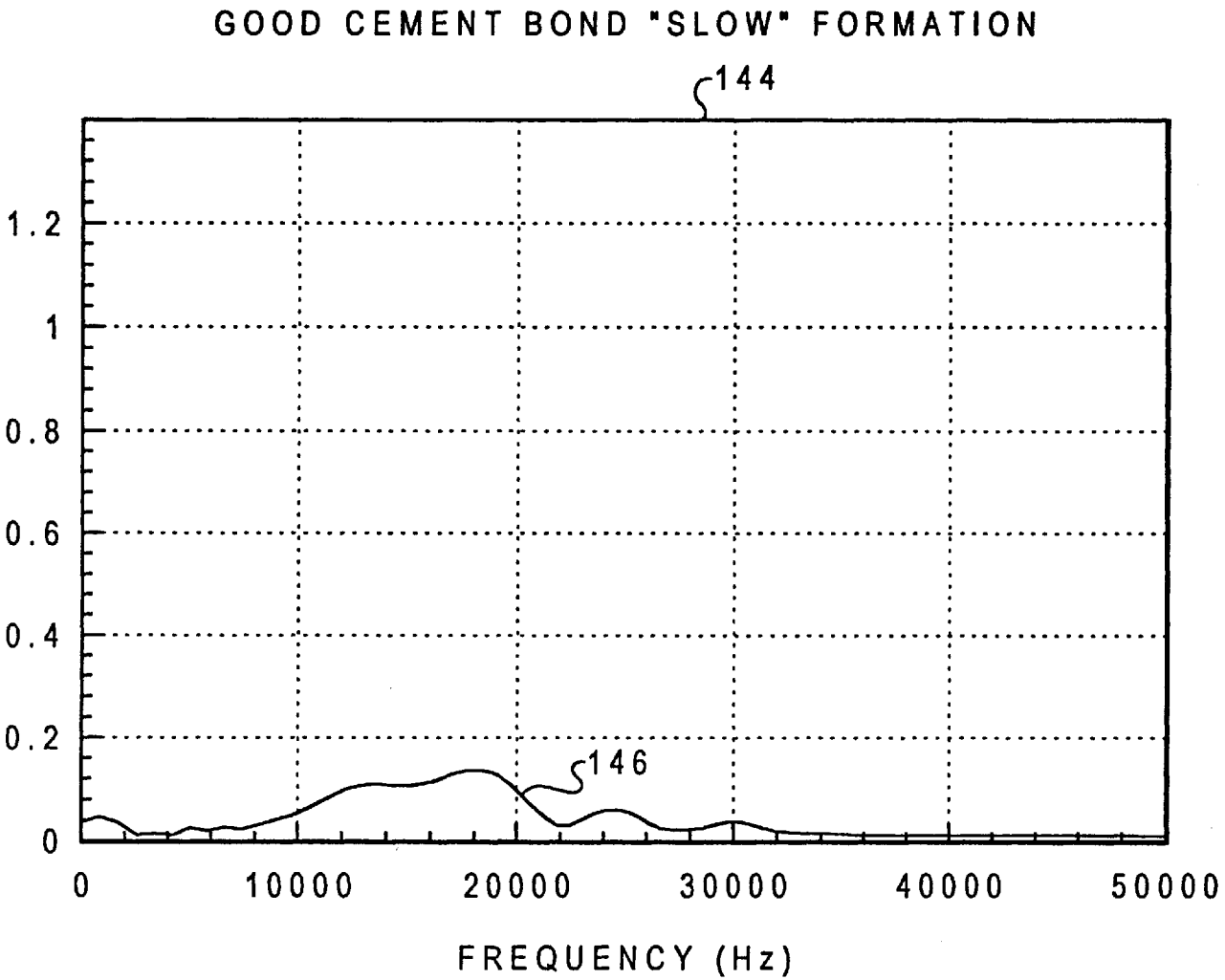
FIG. 6*b* is a frequency domain transformation of the time-domain representation of FIG. 6*a;*

Referring now to FIG. 6*a,* there is depicted a time-domain representation 142 of approximately 500 microseconds of received signal resultant from excitation of a fully bonded casing pipe by a short-duration acoustic pulse in an acoustically "slow" formation. As illustrated in FIG. 6*b,* a frequency domain transformation 144 of time-domain representation 142 is illustrated. The amplitude peak 146 depicted therein is at approximately the resonant frequency of the casing; however, the amplitude, as will be shown herein, is substantially lower than the amplitude which may be present when the casing pipe is fully bonded in an acoustically "fast" formation.

Figure 7A:
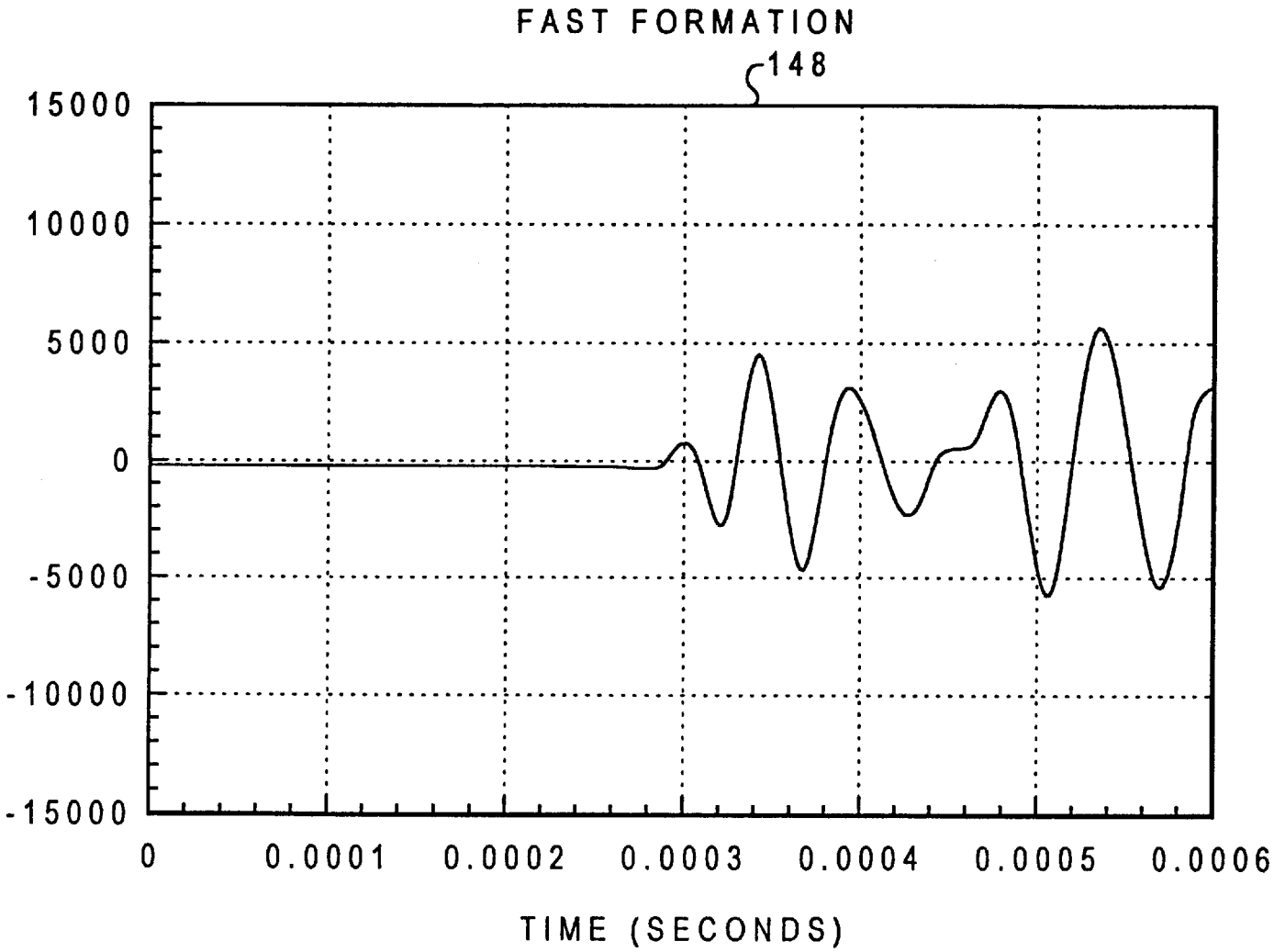
FIG. 7*a* is a time-domain representation of approximately 600 microseconds of a received signal resultant from excitation of a fully bonded casing pipe by a short-duration acoustic pulse in an acoustically "fast" formation.
Figure 7B:
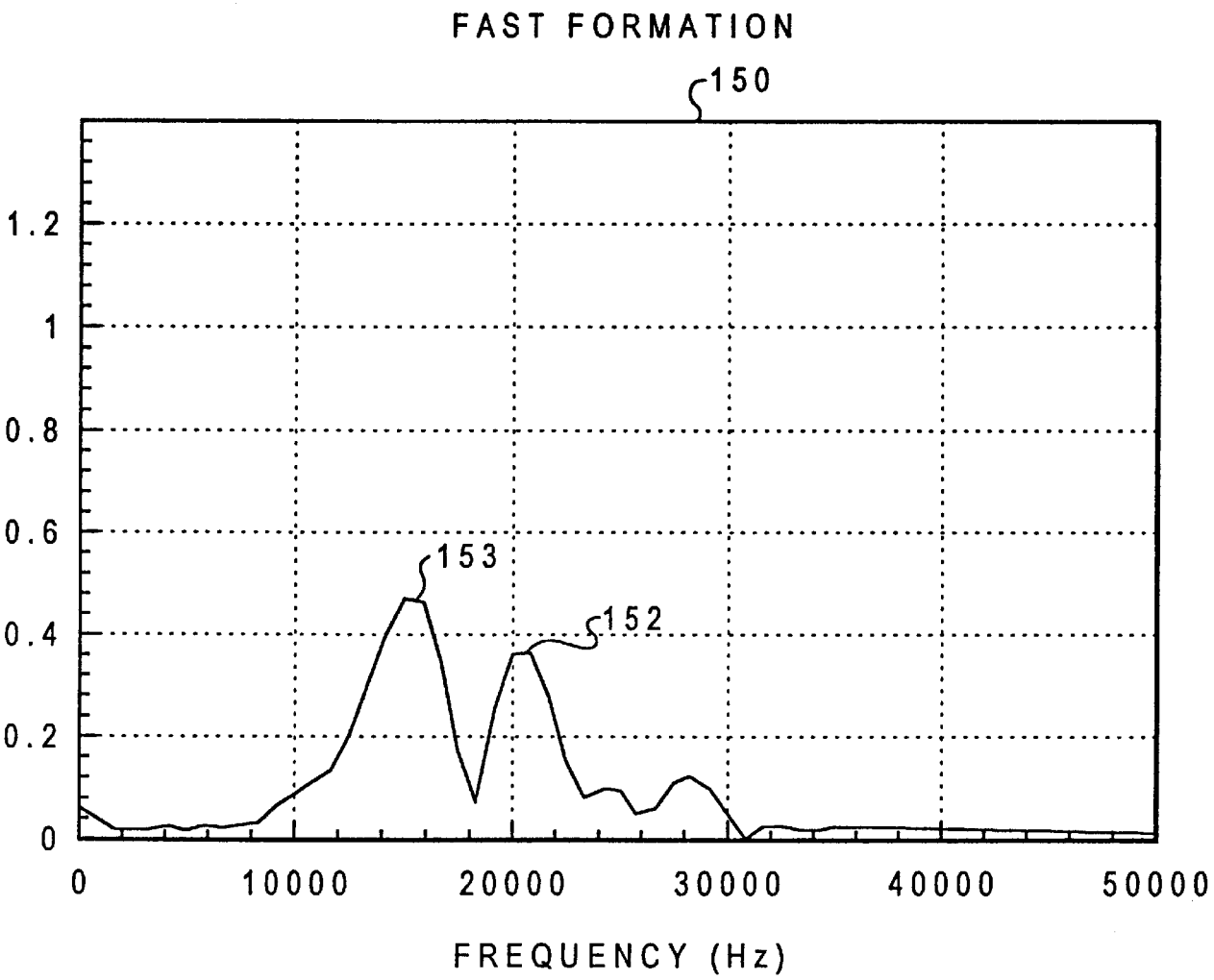
FIG. 7*b* is a frequency domain transformation of the time-domain representation of FIG. 7*a*.

Still referring to FIG. 6*b,* now with reference to FIGS. 7*a* and 7*b,* a time-domain representation 148 of approximately 600 microseconds of received signal resultant from excitation of a fully bonded casing pipe by a short-duration acoustic pulse within an acoustically "fast" formation is depicted. Upon performing a frequency transformation 150 of this signal, as illustrated within FIG. 7*b,* an amplitude peak 152 is obtained which, in addition to being substantially greater in amplitude than the peak depicted within FIG. 6*b,* is shifted in frequency to slightly over 20 kHz. The additional peak 153 corresponds to the "fast" formation resonance frequency.

Upon reference to the foregoing, those skilled in the art will appreciate that, by performing a frequency domain transformation of a received acoustic signal, a determination as to the condition of cement bonding may be accurately obtained despite the presence of high-velocity or so-called "fast" formations. This may be accomplished by analyzing the amplitude of the peak received signal and by comparing the frequency of that peak to a predetermined frequency window surrounding the resonant frequency of the free pipe or free casing. In the depicted embodiment of the invention, it has been determined that a frequency window extending 3 kHz above and below the resonant frequency of free pipe or casing is sufficient to rule out the effect of fast formation upon a bonded casing within the wellbore. In this manner, the erroneous indication of improper cement bonding caused by high-acoustic-velocity formations may be substantially eliminated.

While the invention has been particularly shown and described with reference to a preferred embodiment, it will be understood by those skilled in the art that various changes in form and detail may be made therein without departing from the spirit and scope of the invention.

I claim:

1. A sonic well logging tool for lowering into a borehole fluid within a tubular member having an identified resonant frequency and for evaluating a circumferential placement of sealing material about an exterior surface of said tubular member in the presence of a high-acoustic-velocity formation, said sonic well logging tool comprising:

a housing having a longitudinal access extending therethrough;

an acoustic transmitter and at least one acoustic receiver mounted upon said housing, said at least one acoustic receiver longitudinally spaced from said acoustic transmitter;

means for periodically energizing said acoustic transmitter to apply acoustic energy into said tubular member surrounding said sonic well logging tool;

means for detecting acoustic energy arriving at said at least one acoustic receiver;

means for performing a single frequency domain transformation of said detected acoustic energy; and means for comparing amplitude of said transformed detected acoustic energy only within a predetermined range of said identified resonant frequency of said tubular member to provide an evaluation of circumferential placement of sealing material about an exterior surface of said tubular member despite the presence of a high-acoustic-velocity formation.

2. The sonic well logging tool according to claim 1 wherein said acoustic transmitter comprises a monopole transmitter.

3. The sonic well logging tool according to claim 1 wherein said at least one acoustic receiver comprises eight radially displaced sector receivers.

4. The sonic well logging tool according to claim 3 wherein said eight radially displaced sector receivers are displaced longitudinally at least three feet from said acoustic transmitter.

5. The sonic well logging tool according to claim 1 wherein said acoustic transmitter transmits acoustic energy at a frequency between 20 and 30 kHz.

6. The sonic well logging tool according to claim 1 wherein said means for comparing amplitude of said transformed detected acoustic energy compares amplitudes only within 3 kHz of said identified resonant frequency of said tubular member.

7. A method for evaluating a circumferential placement of a sealing material about an exterior surface of a tubular member in the presence of a high-acoustic-velocity formation, said method comprising the steps of:

determining a resonant frequency of an unsupported section of said tubular member;

transmitting an acoustic pulse into said tubular member within a wellbore at a first location;

detecting acoustic energy traversing said tubular member and formations within said wellbore at a second location longitudinally spaced from said first location;

performing a single frequency domain transformation of said detected acoustic energy; and comparing amplitude of said transformed detected acoustic energy only within a predetermined range of said identified resonant frequency of said tubular member to provide an evaluation of circumferential placement of sealing material about an exterior surface of tubular member despite the presence of a high-acoustic-velocity formation.

8. The method for evaluating a circumferential placement according to claim 7 wherein said step of transmitting an acoustic pulse into said tubular member comprises the step of transmitting acoustic energy within a frequency range of 20–30 kHz.

9. A method for evaluating a circumferential placement according to claim 7 wherein said step of comparing said amplitudes of said transformed detected acoustic energy only within a predetermined range of said identified resonant frequency of said tubular member comprises the step of comparing amplitudes of said transformed detected acoustic energy only within 3 kHz of said identified resonant frequency of said tubular member.

* * * * *